US006265803B1

(12) United States Patent
Caveney

(10) Patent No.: US 6,265,803 B1
(45) Date of Patent: Jul. 24, 2001

(54) UNLIMITED ROTATION VACUUM ISOLATION WIRE FEEDTHROUGH

(75) Inventor: Robert T. Caveney, Windham, NH (US)

(73) Assignee: Brooks Automation, Inc., Chelmsford, MA (US)

( * ) Notice: Subject to any disclaimer, the term of this patent is extended or adjusted under 35 U.S.C. 154(b) by 0 days.

(21) Appl. No.: 09/437,628

(22) Filed: Nov. 10, 1999

(51) Int. Cl.[7] ..... H01R 39/00

(52) U.S. Cl. ..... 310/219; 439/12; 439/20; 439/21; 118/730

(58) Field of Search ..... 310/104, 232, 310/219; 439/12, 13, 20, 21, 27; 438/680, 694; 118/500, 715, 728, 730

(56) References Cited

U.S. PATENT DOCUMENTS

| | | | | |
|---|---|---|---|---|
| 4,448,149 | * | 5/1984 | Brown, Jr. et al. | 118/500 |
| 4,678,952 | * | 7/1987 | Peterson et al. | 310/83 |
| 4,687,596 | * | 8/1987 | Borduz et al. | 252/510 |
| 4,715,921 | * | 12/1987 | Maher et al. | 156/345 |
| 5,273,588 | * | 12/1993 | Foster et al. | 118/723 E |
| 5,302,209 | * | 4/1994 | Maeda et al. | 118/719 |
| 5,562,947 | * | 10/1996 | White et al. | 427/255.5 |
| 5,575,664 | * | 11/1996 | Sobhani | 439/17 |
| 5,720,590 | * | 2/1998 | Hofmeister | 414/744.5 |
| 5,813,823 | * | 9/1998 | Hofmeister | 414/744.5 |
| 5,834,371 | * | 11/1998 | Ameen et al. | 438/656 |
| 5,899,658 | * | 5/1999 | Hofmeister | 414/744.5 |
| 5,923,114 | * | 7/1999 | Senni | 310/232 |

FOREIGN PATENT DOCUMENTS

| | | | |
|---|---|---|---|
| 2523455A1 | * | 12/1975 | (DE) . |
| 11329652A | * | 11/1999 | (JP) . |
| 94/23911 | * | 10/1994 | (WO) . |
| 99/60667 | * | 11/1999 | (WO) . |

* cited by examiner

*Primary Examiner*—Joseph Waks
(74) *Attorney, Agent, or Firm*—Perman & Green, LLP

(57) ABSTRACT

A coaxial drive employs a base member which is secured to a housing and is open to atmosphere and mounts rotatably an interior drive shaft about said base member so that rotation of the drive member in either direction in a full 360° circle. An electrical slip ring is provided between the base and the drive member with a ferrofluidic seal disposed proximate the lower end of the interior drive shaft such that atmospheric pressure passing through the base member and through the electrical slip ring is blocked by the ferrofluidic seal which has an opposite end disposed to the vacuum in the central processing apparatus.

15 Claims, 5 Drawing Sheets

UNLIMITED ROTATION VACUUM ISOLATION WIRE FEEDTHROUGH

TECHNICAL FIELD

The apparatus of the present invention relates generally to material transfer devices. The material transferred might include, but not be limited to, semiconductor wafers, such as Silicon, Gallium Arsenide, semi conductor packing substrates, such as, High Density Interconnects, semiconductor manufacturing process imaging plates, such as masks or recticles, and large area display panels, such as Active Matrix LCD substrates.

The invention further relates to vacuum robot drive technologies for handling wafers or flat panels and relates more particularly to improvements in such technologies whereby electrical power can be brought to the robot arm for purposes of, wafer sensing, wafer gripping and or other sensory applications while nevertheless allowing robot arm angular movement to achieve unlimited rotation through 360 degrees.

Current vacuum robot drive technology for handling wafers or flat panels does not allow electrical power to be brought to the robot arm while simultaneously allowing for unlimited rotation of the drive joint. Providing continuous theta axis rotation to the rotating drive arms in a robot as set forth above to provide unlimited rotational drive, except for example, as limited by the geometry of the robot arms themselves, has been a long felt need. It has always been conceived that if electrical power could be brought from the robot drive to the robot arm, sensing, clamping or measurement devices could be added to the arm linkage.

However, one concern of the electrical feed through was that it would limit the rotation of the arm. If a limit on shaft rotation was placed in such a robotic device, the advantage of the added devices, e.g. sensing, clamping and measuring, would decrease the present capabilities of the device and make them less appealing in the market place.

Accordingly, it is an object of the present invention to provide an unlimited rotation robot drive which allows electrical power to be brought from outside the atmosphere side of the drive unit and into the arms which reside in a vacuum environment.

It is further object of the invention to provide an unlimited angular movement robot drive capable of unlimited angular rotation for the purpose of providing electrostatic wafer clamping, wafer sensing, arm positioning measurement, arm acceleration measurement and wafer position measurement.

It is still a further object of the invention to provide a system which enables unlimited angular rotations of the coaxial drive vacuum robot which is capable of being modified existing coaxial drive structures.

Further objects and advantages of the invention will become apparent from the following disclosure independent claims.

SUMMARY OF THE INVENTION

The invention resides in a coaxial for use in wafer handling and relates more specifically to an improvement therefor whereby the drive is capable of angular rotations fully in a 360 degree circle without interference from electrical connections.

More specifically, the invention resides in a coaxial drive having one part exposed to atmosphere and another part exposed to vacuum. The drive comprises a base member secured to a housing extending vertically therefrom along a central axis, and a drive member having a generally hollow internal confine is disposed over the base member for rotation in either rotational direction with a gap extending therebetween. The drive member and the base include a circumferentially disposed contact means concentrically located about the central axis and the base and the drive members having a contact leads which are located coincidentally with the contact means and in contact therewith along 360° relative rotation between the base member and the drive member. A seal is carried by the drive member and is located thereon between the atmosphere and the vacuum environments and prevents atmosphere from entering the vacuum environment.

DESCRIPTION OF THE DRAWINGS

The foregoing aspects and other features of the invention are explained in the following description taken in connection with the accompanying drawings, wherein.

DETAILED DESCRIPTION OF THE PREFERRED EMBODIMENT

Figure 1:
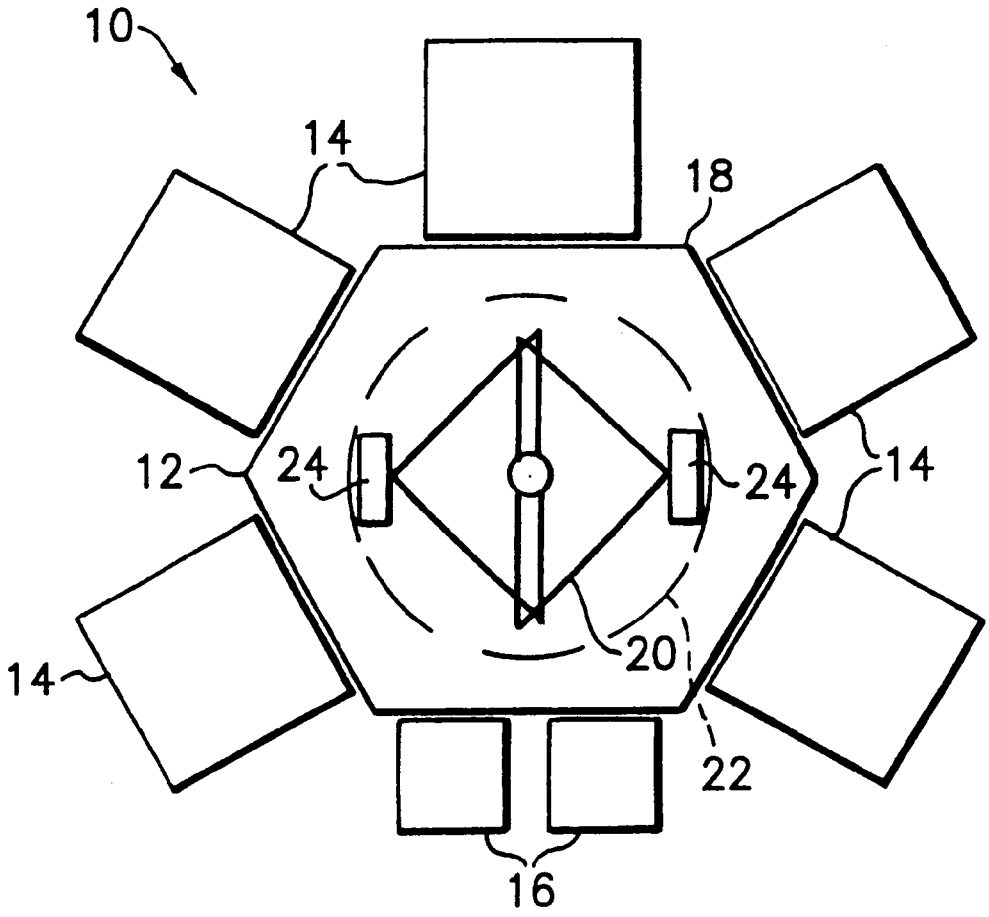
FIG. 1 is a schematic top plan view of a substrate processing apparatus having a substrate transport incorporating features of the present invention.

Referring now to FIG. 1, there is shown in a schematic top view of a substrate processing apparatus 10. The apparatus 10 includes a substrate transport 12, substrate processing modular 14 and load lock 16. A similar substrate processing apparatus is disclosed in U.S. Pat. No. 4,715,921 which is hereby incorporated by reference in its entirety. U.S. patent application Ser. No. 08/048,833 discloses an articulated arm transfer device which is also hereby incorporated by reference in its entirety. The apparatus 10 is adapted to process substrates, such as, semiconductor wafers or flat panel displays, as is known in the art.

The transport 12 includes a housing 18, a moveable arm assembly 20 and a drive assembly 22. The processing modules 14 and load locks 16 are attached to sides of the housing 18. The housing 18 forms a vacuum chamber in which the arm assembly 20 can transport substrates between and or among the load lock 16 and the processing modules 14. The arm assembly 20 can be similar to that described in U.S. patent application Ser. No. 08/048,833 with substrates supporting and effectors 24. In alternative embodiments, other types of housings and/or moveable arm assemblies could be used in conjuction with the present invention.

Figure 1A:
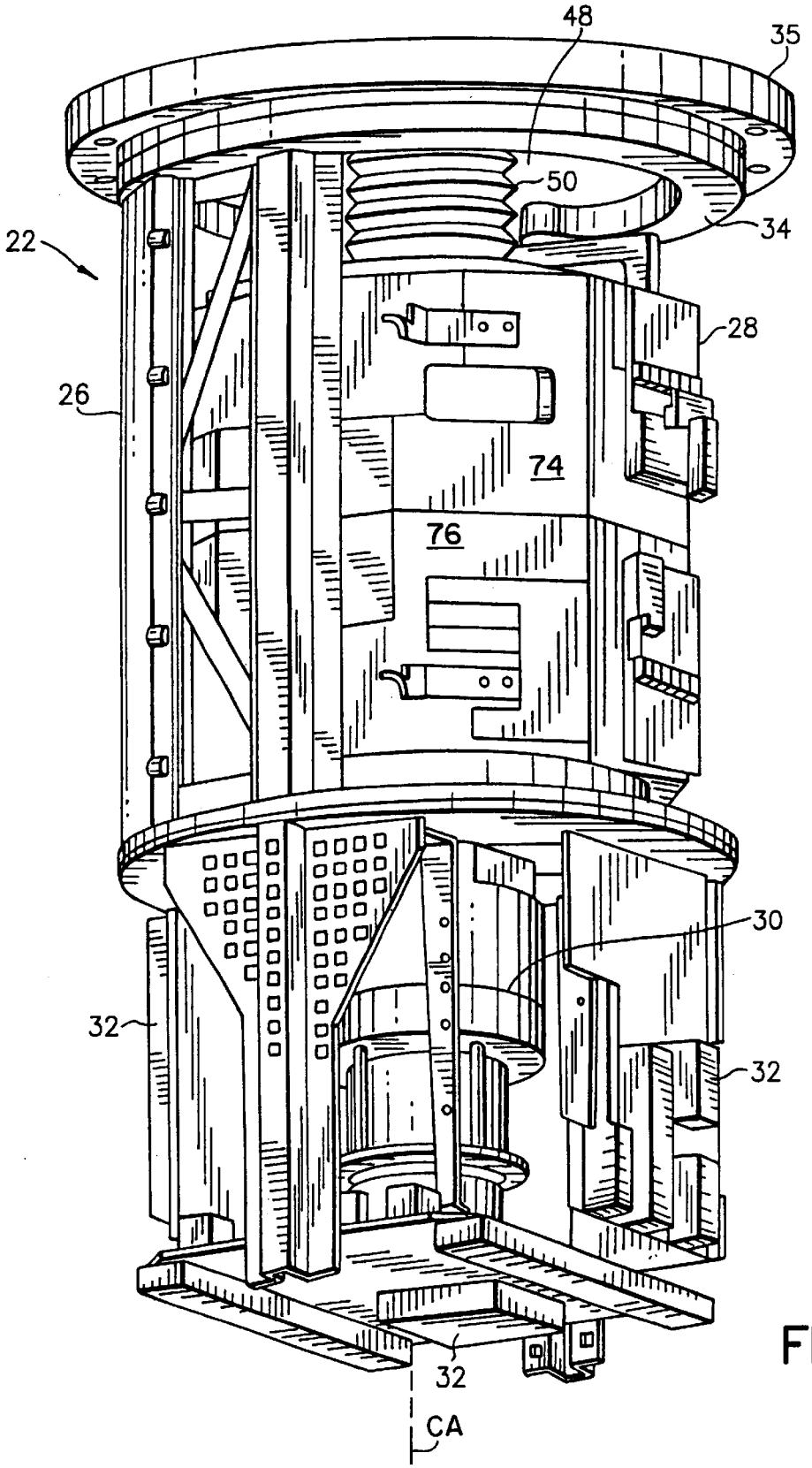
FIG. 1*a* is a perspective view of the same substrate transport drive assembly used in the apparatus used in FIG. 1.

Referring now to FIG. 1*a*, the drive assembly 22 is shown. The drive assembly 22 includes a frame 26, a rotational drive assembly 28, a vertical drive 30, and a controller 32. The drive assembly 22 is mounted to the underside U of the housing 18. The frame 26 includes a top flange 34 which is stationarily attached to the mounting flange 35 which is secured to the bottom U of the housing 18. A carriage driveably connected to the vertical drive 30 and disposed along ways on the frame 26 is controllably vertically moveably positionable between upper and lower positions as required by use. A top flange 34 as seen in FIG. 1*a* has a circular opening 48 and a portion of the drive shaft assembly of the rotational drive assembly 28 projects through the hole 48 and through a hole through the bottom U of the housing 18 into the vacuum chamber formed by the housing. A bellows 50 is provided between the underside U of the housing 18 and the drive assembly 28 to maintain the vacuum in the vacuum chamber, but allows the rotational drive assembly 28 to be moveable vertically relative to the housing 18.

Figure 2:
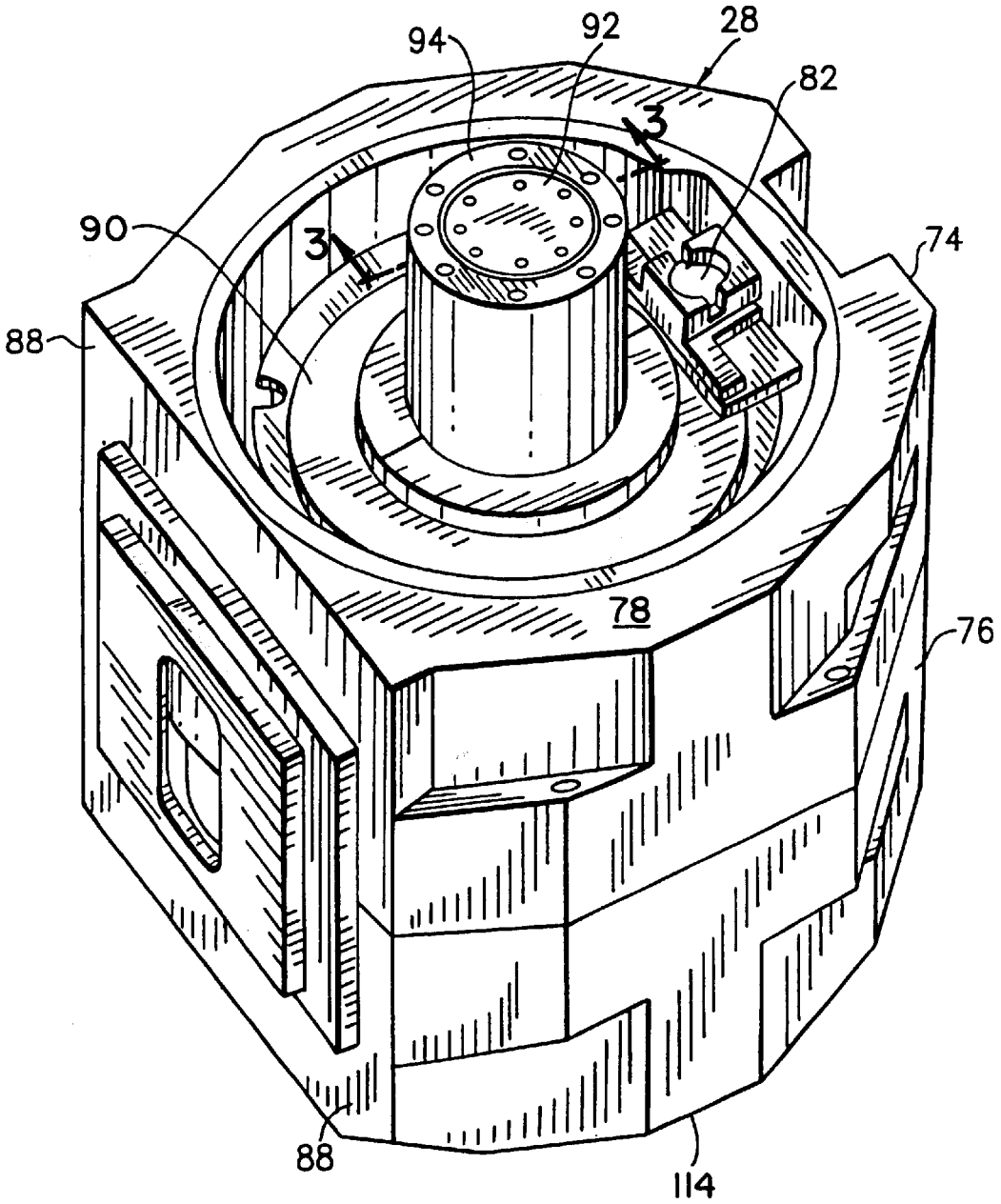
FIG. 2 is a perspective view of the rotational drive assembly shown in FIG. 1*a*.

Referring now to FIG. 2, and the rotational drive assembly 28. The rotational drive assembly 28 includes two rotational drive units 74 and 76. A positioning signaling device 82 may be provided thereon for determining the real time position of the robot arms. The two units 74 and 76 are substantially identically identical to one another and are attached to one another in reverse orientation in a stacked vertical arrangement. Each unit 74, 76 has a housing 88 which are suitably sized and shaped to be located within the cage frame 26. The units 74 and 76 are fixedly connected to each other to form a modular unit that is secured to the carriage of the drive assembly 22 driven by the vertical drive 30. Each unit 74, 76 is adapted to independently angularly rotate one of two drive shafts 92, 94 of the driveshaft assembly 90. The two driveshafts, outer and inner, 92 and 94, are coaxially mounted to the rotational drive assembly 28 coincidentally about the central axis CA, and the top ends of the shafts 92 and 94 are each connected to a member of the moveable arm assembly 20 such that rotation of the driveshafts in a given angular direction causes a robot arms to rotate together, while rotation of the shafts 92, 94 in opposite directions causes the extension/retraction of the arms in a frog leg type manner.

Figure 3:
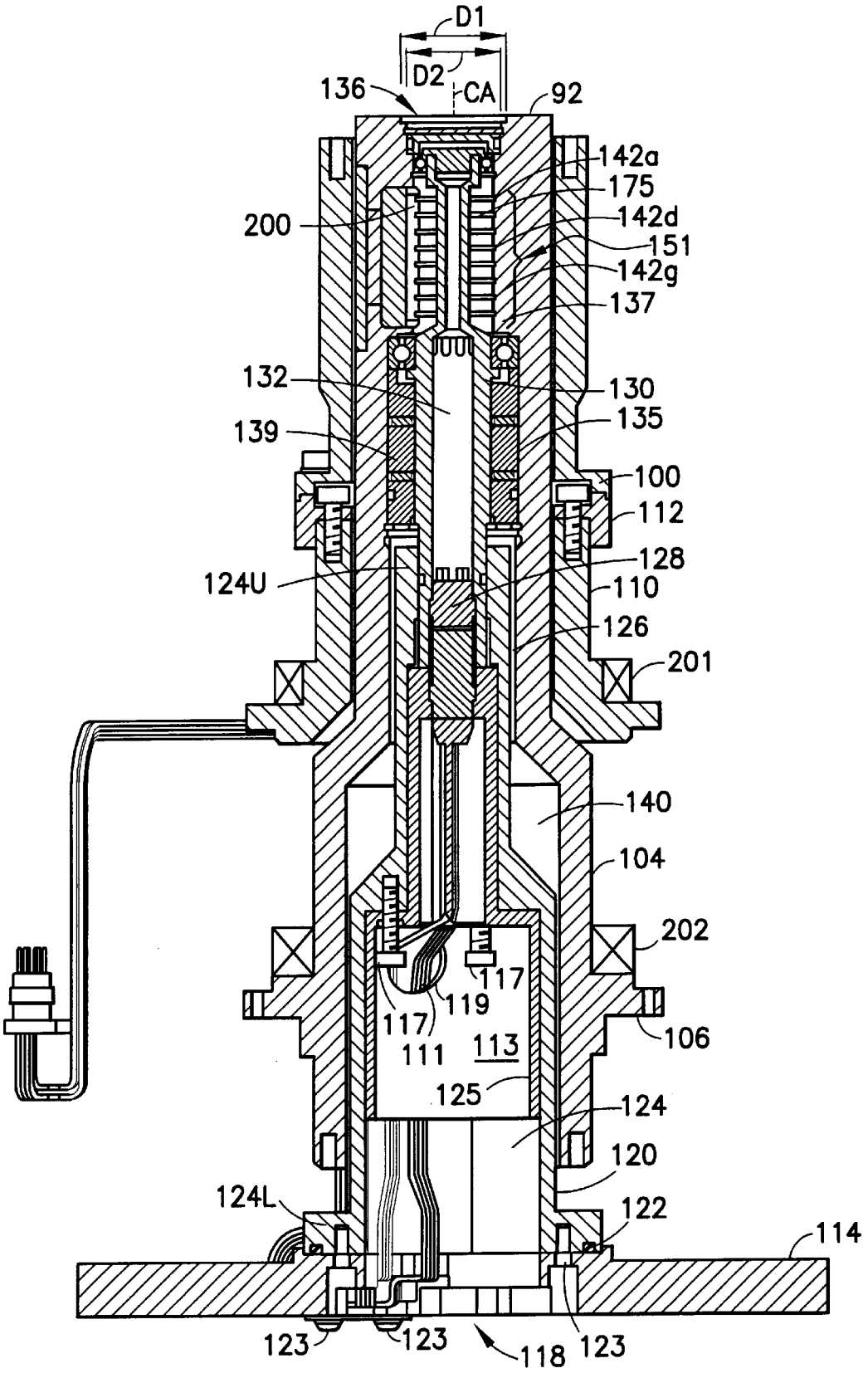
FIG. 3 is a vertical sectional view of the drive assembly taken along line 3—3 in FIG. 2.
Figure 4:
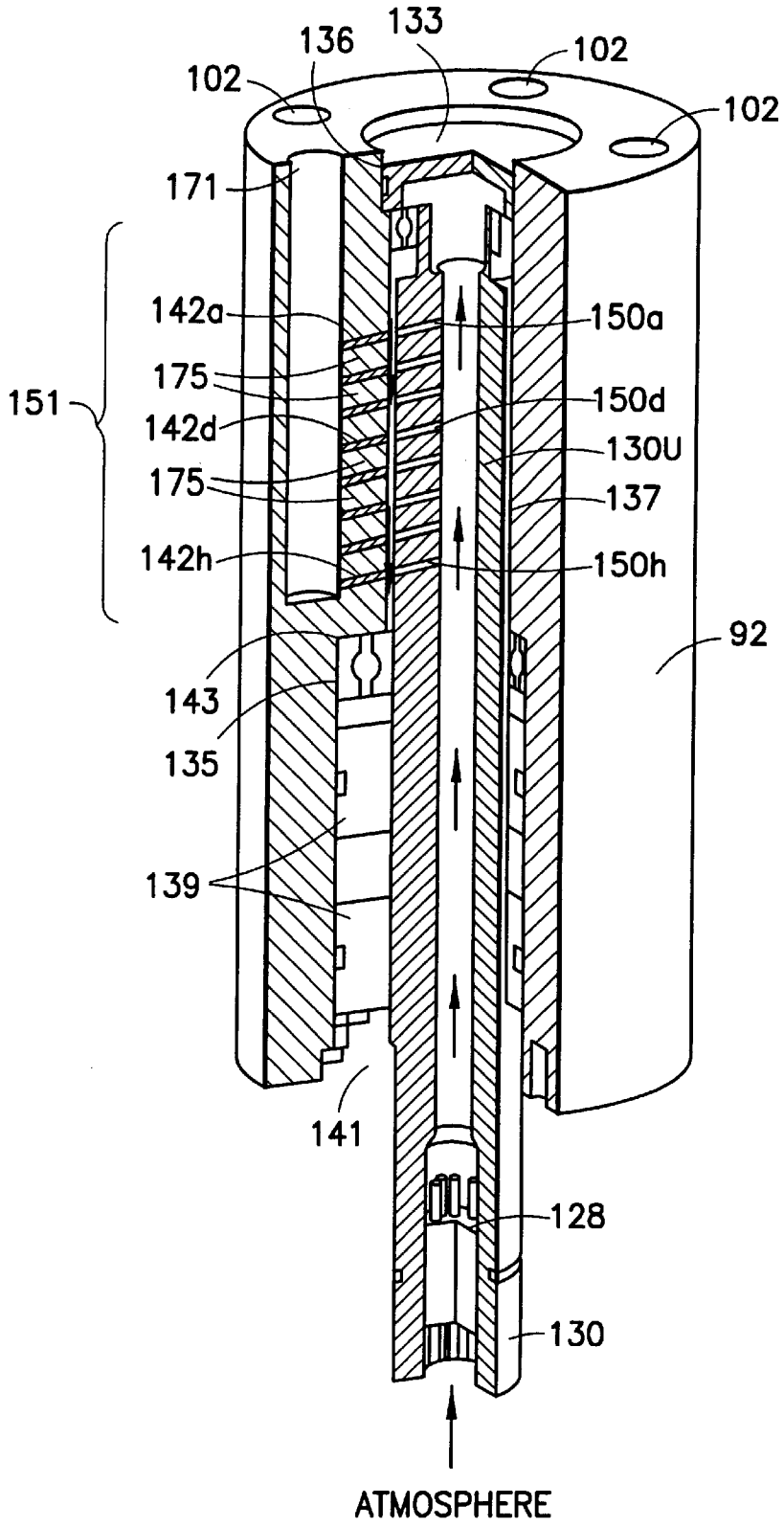
FIG. 4 is a schematic isolated view of the inner coaxial shaft of the feed through part of the drive assembly.

Referring now to FIG. 3, it should be seen that the drive assembly shown therein are coaxially disposed along the central access CA of FIG. 4 within the drive units of 74,76 respectively. The radially outwardly disposed outer driveshaft 94 has an annular flange 100 disposed thereabout and has a set of permanent magnets 201 attached to the flange 100 and placed in juxtaposition relative to circumferentially surrounding coils (not shown) within the unit 74. Likewise, the radially inwardly located inner driveshaft 92 connects through a plurality of axially extending bolts placed through openings 102, which threadily engage with a lower inner coaxial shaft 104 such that both the lower inner coaxial shaft 104 and the inner driveshaft 92 are nonrotatably connected with one another in axial confrontation about the central access CA.

Adjacent the bottom end of the lower inner coaxial shaft 104 is a second annularly extending flange 106 on which is disposed a set of permanent magnets 202 which are in juxtaposition with coils (not shown) mounted to the lower housing 76 for the purpose of controllably rotating the inner driveshaft 92 between angular orientations. The lower inner axial shaft 104 and the outer coaxial driveshaft 94 are axially separated from one another by a separating flange 110 disposed therebetween, and as between the outer coaxial driveshaft 94 and the separating flange 110 with a bearing plate 112 interposed therebetween.

In accordance with the invention, it should be seen that a bottom plate 114 is provided at the bottom of the unit 76. The bottom plate 114 has an opening or hole 118 which is exposed to atmosphere and is disposed coincidentally with the central axis CA. The isolation cup 120 is fixedly mounted to the bottom plate 114 about the hole 118 with an 0-ring seal 122 therebetween. The isolation cup 120 is secured against movement to the bottom plate 114 through the intermediary of a plurality of connecting screws and locating pins 123, 123. Rotatably disposed coaxially about the isolation cup 120 is the lower inner shaft 104. The units 74 and 76 support the component parts shown in FIG. 3 in such a way, using suitable bearing means, that a vertically extending annular gap 140 is provided between the isolation cup 120 and the lower inner axial shaft 104.

The isolation cup 120 has a hollow inner chamber 124 which extends coaxially about the central axis CA through between the upper and lower ends 124U, 124L thereof. The isolation cup 120 narrows towards its top end to define a generally cylindrical tubular collar portion 126. Within the tubular collar portion 126 is located an electrical connector 125. The electrical connector 125 is of a tubular shape and has a base 113 in which is formed an opening 119 through which wires 111 are passed which ultimately electrically connect to the robot arm. The connector 125 is secured by bolts 117 to the cup 120 in the manner illustrated.

Also disposed within the hollow tubular confines of the tubular collar portion 126 is a central contact shaft 130 which is nonrotatably and sealingly connected to the isolation cup 120 through the intermediary of a spline connection or a transverse fastening pin and seals. At bottom end of the central contact shaft 130 is disposed an electrical connector 128 which is configured to axially mate with the connector part 125. The electrical connector 128 is secured against axial movement, such as by an annular groove and snap ring, to the shaft 130. Since the electrical connector 128 is secured within an atmospheric environment which is allowed to pass through and beyond the connector 128, the connection can be made using any suitable type of connection, such as by the snap-fit, or adhesive connection because the forces acting upon the connector will not be exaggerated, such as found in the case where atmosphere and vacuum interface exists. Thus, the shaft 130 is axially and rotatably immovable relative to the isolation cup 120, and the frame of the assembly thereby preventing twisting of the electrical wires 111 which are fed upwardly through the hollow portion 132 of the shaft 130. In this way, the feed through connection 125/128 and its associated wires can be removeable without disassembly of the robotic drive mechanism. Thus, the wires 111 connect to the connector 128 by the mating of the connector 125 inserted therewithin.

As illustrated in FIG. 4 the interiorly disposed driveshaft 92 has a coaxially disposed stepped opening 136 formed therein. The top end of the interiorly disposed driveshaft 92 has a seal cap 133 which provides an end wall and locks the opening 136 from vacuum. The stepped opening seal 136 is defined by a first cylindrical portion 135 having a diameter D1 and a second cylindrical portion 137 having a diameter D2 which is less than that of the first portion 135. The first cylindrical portion 135 is correspondingly sized and shaped to receive a ferrofludic seal 139 which is disposed circumferentially and axially secured against movement about the central contact shaft 130. The interior surface of the inner coaxial shaft 92 defining the second cylindrical portion 137 is correspondingly sized and shaped to receive for relative rotation therewith the upper end portion 130U of the central contact shaft 130.

As previously mentioned, the outer surface of the isolation cup 120 and the inner surface of the lower inner shaft 104 are spaced apart by the gap 140 which exposes the lower end 141 of the seal 136 to the vacuum within the chamber of the handling apparatus. Thus, as illustrated by the arrow line in FIG. 4, vacuum is presented against the end 141 of the seal 139 while the upper inner end 143 of the seal 139 is exposed to atmosphere thereby providing the required differential in pressure necessary for effecting proper functioning of the ferrofluidic seal 139. It should be understood that the ferrofluidic seal 139 is one that is readily commercially available and sold for example by Ferrofluidics, Inc., of Naushua, N.H. and is known in the industry.

Referring now in greater detail to FIGS. 3 and 4, and to the means 151 for rotatatably maintaining an electrical connection between the top end of the shaft 130 and the inner coaxial shaft 92, it should be seen that this means is comprised of a plurality of slip-rings and include a plurality of vertically spaced circumferentially disposed grooves 142*a–h* formed in the inner cylindrical surface of the second cylindrical portion 137 of the opening 136. Each groove extends radially outwardly into the surface of the cylindrical opening portion 137 of the inner coaxial shaft 92. Within each of these grooves is located an annular metallic contact 175 electrically connected and secured to the central contact shaft 130. At the top end of the central contact shaft 130 and in the confronting surface of the inner surface of the cylindrical portion 137 of the interior drive shaft 92 is located a plurality of transversely extending openings 150*a*–150*h* (see FIG. 4) each located in alignment with an associated one of the contact grooves 142*a–h*. Within each of the transverse openings 150*a*–150*h* is located a lead (not shown) corresponding and connected to one of the contact brushes 175 which are fixed to the shaft 130. Each lead is further connected to a corresponding lead on the connector 128. In the case of the drive member 92, each of the contact brushes 175 corresponds to an electrical device in the robot arm. The grooves 142*a–h* in the surface 137 connect to the robot arm by lines within a conduit 171 (see FIG. 4) in the shaft 92 which communicate with a chamber 200 in the member 92. The brushes 175 of the central contact shaft 130 maintain sliding point contact with the associated one of the annular metallic contact grooves 142*a–h* while those of the other part may have a fixed connection therewith. Electrical contact is thus maintained in a full 360 degrees circle by the sliding contact of the leads with the contact rings.

By the foregoing an improved coaxial drive electric contact has been described by way of the preferred embodiment. However, numerous modifications and substitutions may be had without departing from the spirit of the invention. For example, it is well within the purview of the invention to provide contact rings about the outer surface of the central shaft 130 such that pint contact is effected by the leads of either or both the inner coaxial shaft 982 and/or the central.

Accordingly the invention has been described by way of illustration rather than limitation.

What is claimed is:

1. In a coaxial drive device, an electrical connection between two coaxially driven parts comprising:

an isolation cup extending along a central axis and having a bottom opening and a central shaft opening to a topmost opening;

a drive member coaxially disposed about said isolation cup for rotation in either angular direction;

a central contact shaft non-rotatably secured to said isolation cup through the topmost opening thereof;

said drive member having a hollow interior extending coaxially along said central axis and being of a stepped configuration as defined by a first cylindrical opening having a first given diameter and a second cylindrical opening having of a second given diameter communicating with said first cylindrical opening;

said first given opening diameter being smaller than said second given opening diameter and said first cylindrical opening ending in an endwall;

a ferrofluidic seal located within said second cylindrical opening of said drive member, and being sized to receive said central contact shaft therein;

said first cylindrical opening being sized to receive a portion of said central contact shaft therein; and at least one annular contact ring connected to the central contact shaft and held in an associated electrical passage disposed in an inner surface of said first drive member defining said first cylindrical opening to define an electrical slip ring between the central contact shaft and drive member;

wherein the ferrofluidic seal in the second cylindrical opening is disposed between the central contact shaft and said drive member for keeping vacuum from said contact ring.

2. A coaxial drive having one part exposed to an atmosphere and another part exposed to a vacuum, said drive comprising:

a base member secured to a housing extending vertically therefrom along a central axis;

a drive member having a generally hollow internal confine which is disposed over said base member for rotation in either rotational direction with a gap extending therebetween;

said drive member and said base including a circumferentially disposed contact means concentrically located about said central axis between said base and said drive member, said drive member having contact leads which are located coincidentally with said contact means and in contact therewith for effecting a 360° relative rotation contact between said base member and said drive member; and a seal carried by said drive member and located thereon between said atmosphere and said vacuum so as to prevent said atmosphere from entering said vacuum.

3. A coaxial drive as defined in claim 2 further characterized by said drive member having a plurality of permanent magnets disposed circumferentially thereabout.

4. A coaxial drive as defined in claim 2 further characterized by said base being defined by an isolation cup having a top and a bottom end and a central contact shaft which is mounted to the top end of said isolation cup.

5. A coaxial drive as defined in claim 4 further characterized by an electrical connector being housed within the central contact shaft and having a plurality of leads which extend along the central axis.

6. A coaxial drive as defined in claim 5 further characterized by said central shaft having a hollow interior confine and having a plurality of openings extending transversely of said central axis.

7. A coaxial drive as defined in claim 6 further characterized by said drive member having a stepped interior confine as defined by a first cylindrical opening ending in an end wall at a top end of said drive member and a second cylindrical opening communicating with said first cylindrical opening and ending in an opened end of said drive member.

8. A coaxial drive as defined in claim 7 further characterized by a second drive member disposed coaxially about said drive member and said base member and having a plurality of permanent magnets disposed annularly thereabout.

9. A coaxial drive as defined in claim 8 further characterized by said seal being a ferrofluidic seal which is disposed in said second opening of said drive member.

10. A coaxial drive as defined in claim 9 further characterized by providing a gap between said base and said drive member, the gap being in said vacuum, and using said ferrofluidic seal to seal the gap and to separate said vacuum from said atmosphere which is associated with a side of the seal which is located facing said first cylindrical opening of said drive member.

11. A coaxial drive as defined in claim 10 further characterized by a second drive member disposed coaxially about said drive member and said base member and having a plurality of permanent magnets disposed annularly thereabout.

12. A coaxial drive as defined in claim 9 further characterized by a location of said plurality of permanent magnets on said one drive member being in a location axially different from the location of said plurality of permanent magnets on said second drive member.eb;normal

13. A coaxial drive as defined in claim 7 further characterized by said drive member having a plurality of circumferentially disposed contact rings disposed along a surface defining said first cylindrical opening therein and being located axially spaced along said central axis coincidentally with each of said plurality of transverse openings.

14. A coaxial drive as defined in claim 13 further characterized by said drive member including an axially extending opening formed through a top surface of said drive member which communicates with each of said contact rings for housing a lead associated with each of said contact rings for connection with an electrical apparatus.

15. A coaxial drive as defined in claim 2 further characterized by contact means being disposed in communication with said gap and said atmosphere environment.

* * * * *